US009782051B2

(12) United States Patent
Hayase et al.

(10) Patent No.: US 9,782,051 B2
(45) Date of Patent: Oct. 10, 2017

(54) NON-WOVEN FABRIC SUBSTRATE FOR WIPING SHEET

(71) Applicant: Kao Corporation, Tokyo (JP)

(72) Inventors: Taeko Hayase, Utsunomiya (JP); Emiko Shirasaki, Oyama (JP); Minoru Wada, Kawasaki (JP)

(73) Assignee: KAO CORPORATION, Tokyo (JP)

( * ) Notice: Subject to any disclaimer, the term of this patent is extended or adjusted under 35 U.S.C. 154(b) by 217 days.

(21) Appl. No.: 14/440,559

(22) PCT Filed: Nov. 8, 2013

(86) PCT No.: PCT/JP2013/080224

§ 371 (c)(1),
(2) Date: May 4, 2015

(87) PCT Pub. No.: WO2014/087797

PCT Pub. Date: Jun. 12, 2014

(65) Prior Publication Data

US 2015/0282686 A1 Oct. 8, 2015

(30) Foreign Application Priority Data

Dec. 4, 2012 (JP) ..... 2012-265037

(51) Int. Cl.
*D04H 1/495* (2012.01)
*A47L 13/16* (2006.01)
*A47L 13/17* (2006.01)

(52) U.S. Cl.
CPC ..... *A47L 13/16* (2013.01); *A47L 13/17* (2013.01); *D04H 1/495* (2013.01);
(Continued)

(58) Field of Classification Search
None
See application file for complete search history.

(56) References Cited

U.S. PATENT DOCUMENTS 3,081,515 A * 3/1963 Griswold ..... D04H 1/736 162/114
3,193,436 A * 7/1965 Kalwaites ..... D04H 1/74 428/113
(Continued)

FOREIGN PATENT DOCUMENTS

EP 1 764 023 A1 3/2007
EP 2 034 071 A1 3/2009
(Continued)

OTHER PUBLICATIONS

English Abstract for JP 01321961 A, Dec. 1989.*
(Continued)

*Primary Examiner* — Jeff Vonch
(74) *Attorney, Agent, or Firm* — Birch, Stewart, Kolasch & Birch, LLP

(57) ABSTRACT

Provided is a nonwoven fabric substrate (1) in which ridges (2) and grooves (3) are alternately formed at positions corresponding to each other on each of both surfaces (1*a*, 1*b*), and apertures (4) penetrating the grooves (3) of both surfaces are formed. The ridges (2) and the grooves (3) extend parallel to each other. The ridges (2) and the grooves (3) extend in a direction intersecting with each of a pair of both sides (1*c*, 1*d*) extending in parallel of the nonwoven fabric substrate (1). In planar view, each of the grooves (3) alternately includes an aperture portion (3*h*) which has a plurality of the apertures (4), and a non-aperture portion which has no aperture (4) and is longer than a distance between the nearest end portions of the adjacent apertures (4) in the aperture portion (3*h*), and arrangement patterns of the aperture portion (3*h*) and the non-aperture portion (3*n*) provided in the adjacent grooves (3) are different from each other. When the nonwoven fabric substrate (1) is seen in planar view, the nonwoven fabric substrate (1) has an aperture region (11) formed by the aperture portion (3*h*) of
(Continued)

the plurality of grooves (3), and a non-aperture region (12) formed by the non-aperture portion (3*n*), and the aperture region (11) and the non-aperture region (12) are arranged in a predetermined pattern.

8 Claims, 2 Drawing Sheets

(52) U.S. Cl.
CPC .. *Y10T 428/2457* (2015.01); *Y10T 428/24273* (2015.01); *Y10T 428/24603* (2015.01); *Y10T 442/20* (2015.04); *Y10T 442/2525* (2015.04); *Y10T 442/277* (2015.04); *Y10T 442/60* (2015.04); *Y10T 442/689* (2015.04)

(56) References Cited

U.S. PATENT DOCUMENTS 3,345,243 A * 10/1967 Kalwaites ..... D04H 1/70 428/131
3,485,706 A * 12/1969 Evans ..... D04H 1/495 162/115
3,498,874 A * 3/1970 Shambelan ..... D04H 1/495 162/115
3,679,535 A * 7/1972 Kalwaites ..... D04H 1/74 28/105
3,679,536 A * 7/1972 Kalwaites ..... D04H 1/74 28/105
3,681,182 A * 8/1972 Kalwaites ..... D04H 1/736 28/105
3,681,183 A * 8/1972 Kalwaites ..... D04H 1/74 28/105
3,681,184 A * 8/1972 Kalwaites ..... D04H 1/74 28/105
3,737,368 A 6/1973 Such et al.
4,465,726 A * 8/1984 Holmes ..... D04H 1/495 28/105
4,612,226 A * 9/1986 Kennette ..... D04H 1/49 428/131
4,623,575 A * 11/1986 Brooks ..... D04H 1/48 156/209
4,693,922 A * 9/1987 Buyofsky ..... D04H 1/495 28/105
4,735,842 A * 4/1988 Buyofsky ..... D04H 1/495 28/105
4,840,829 A * 6/1989 Suzuki ..... D04H 1/495 428/131
4,859,519 A * 8/1989 Cabe, Jr. ..... A61F 13/512 264/156
4,925,722 A * 5/1990 Jeffers ..... D04H 1/64 428/131
4,960,630 A * 10/1990 Greenway ..... B29C 59/02 28/104
4,967,456 A * 11/1990 Sternlieb ..... D06C 29/00 28/104
4,970,104 A * 11/1990 Radwanski ..... D04H 1/56 428/32.1
5,204,158 A * 4/1993 Phillips ..... D04H 18/04 28/104
5,245,025 A * 9/1993 Trokhan ..... D21F 11/006 536/56
5,281,461 A * 1/1994 Greenway ..... D04H 18/04 428/105
5,527,428 A * 6/1996 Trokhan ..... D21F 11/006 162/109
5,618,610 A * 4/1997 Tomita ..... D04H 1/498 28/104
5,620,694 A * 4/1997 Girardot ..... D04H 1/593 424/402
5,632,072 A * 5/1997 Simon ..... B29C 59/02 26/69 R
6,270,623 B1 * 8/2001 Goda ..... A61F 13/512 162/109
6,451,718 B1 * 9/2002 Yamada ..... A61F 13/84 428/152
6,455,129 B1 * 9/2002 Kershaw ..... B31F 1/07 156/205
6,509,079 B1 * 1/2003 Suehr ..... D04H 18/04 28/103
6,550,092 B1 * 4/2003 Brown ..... A47L 13/16 15/104.002
6,632,504 B1 * 10/2003 Gillespie ..... B26F 1/00 428/131
6,641,902 B1 * 11/2003 Kobayashi ..... D04H 1/495 428/198
D582,618 S * 12/2008 Caruso ..... D32/40
8,257,818 B2 * 9/2012 Ellis ..... A47L 13/17 15/104.002
D697,722 S * 1/2014 Shanbhag ..... D5/47
D702,047 S * 4/2014 Rhodes, III ..... D5/58
2003/0019088 A1 * 1/2003 Carter ..... D04H 1/495 28/104
2003/0026945 A1 * 2/2003 Lasko ..... A61F 13/15731 428/131
2003/0106568 A1 6/2003 Keck et al.
2004/0116029 A1 * 6/2004 Kelly ..... A61F 13/512 442/394
2004/0121121 A1 * 6/2004 Anderson ..... B26D 7/14 428/131
2005/0003152 A1 * 1/2005 Thomas ..... A61F 13/4902 428/131
2006/0063456 A1 * 3/2006 Carter ..... D04H 3/11 442/327
2006/0276356 A1 12/2006 Panandiker et al.
2007/0060003 A1 * 3/2007 Ellis ..... A47L 13/17 442/121
2007/0128411 A1 * 6/2007 Kawai ..... A47L 13/16 428/170
2007/0298213 A1 * 12/2007 Noda ..... A61F 13/51 428/131
2007/0298214 A1 * 12/2007 Noda ..... D04H 1/4382 428/138
2007/0298220 A1 * 12/2007 Noda ..... A61F 13/51476 428/152
2007/0298667 A1 * 12/2007 Noda ..... D04H 1/72 442/50
2007/0298671 A1 * 12/2007 Noda ..... D04H 1/42 442/334
2008/0010795 A1 * 1/2008 Mizutani ..... D06C 3/00 28/178
2008/0044622 A1 * 2/2008 Noda ..... D04H 1/74 428/131
2008/0044628 A1 * 2/2008 Noda ..... D04H 1/54 428/163
2009/0320878 A1 * 12/2009 Noelle ..... A47L 13/16 134/6
2013/0017370 A1 * 1/2013 Yamaguchi ..... A61F 13/51121 428/167
2013/0022784 A1 * 1/2013 Uematsu ..... A61F 13/51104 428/138
2013/0034686 A1 * 2/2013 Mitsuno ..... D04H 3/14 428/131
2013/0232712 A1 * 9/2013 Kawai ..... A47L 13/16 15/209.1
2015/0297053 A1 * 10/2015 Hayase ..... A47L 13/16 15/104.93

FOREIGN PATENT DOCUMENTS

JP 01321961 A * 12/1989
JP 4-146714 A 5/1992
JP 08174735 A * 7/1996
JP 09324354 A * 12/1997
JP 10-131014 A 5/1998
JP 11048381 A * 2/1999
JP 2000045161 A * 2/2000
JP 2002-30557 A 1/2002

(56) References Cited

FOREIGN PATENT DOCUMENTS

| | | | | |
|---|---|---|---|---|
| JP | 2002038363 | A | * | 2/2002 |
| JP | 2002249965 | A | * | 9/2002 |
| JP | 2003-230520 | A | | 8/2003 |
| JP | 2003230520 | A | * | 8/2003 |
| JP | 2006-6537 | A | | 1/2006 |
| JP | 2006-233345 | A | | 9/2006 |
| JP | 2006-291437 | A | | 10/2006 |
| JP | 2007-167212 | A | | 7/2007 |
| JP | 2008127688 | A | * | 6/2008 |
| JP | 2008-213194 | A | | 9/2008 |
| JP | 2009062650 | A | * | 3/2009 |
| JP | 2009215667 | A | * | 9/2009 |
| JP | 2009287158 | A | * | 12/2009 |
| JP | 2011021310 | A | * | 2/2011 |
| JP | 2011117095 | A | * | 6/2011 |
| JP | 2011-137279 | A | | 7/2011 |
| SG | D2013/753 | I | | 5/2013 |

OTHER PUBLICATIONS

Machine Translation of JP 2009062650 A, Mar. 2009.*

Machine Translation of JP 2011117095 A, Jun. 2011.*

International Preliminary Report on Patentability and English translation of the Written Opinion of the International Searching Authority (forms PCT/IB/373, PCT/ISA/237 and PCT/IB/338), dated Jun. 18, 2015, for International Application No. PCT/JP2013/080224, with a translation of the Written Opinion.

Extended European Search Report, issued May 3, 2016, for European Application No. 13860604.1.

International Search Report (Form PCT/ISA/210) for International Application No. PCT/JP2013/080223, dated Jan. 14, 2014.

International Search Report, issued in PCT/JP2013/080224, dated Jan. 14, 2014.

Extended European Search Report, dated Jun. 10, 2016, for European Application No. 13860345.1.

* cited by examiner

NON-WOVEN FABRIC SUBSTRATE FOR WIPING SHEET

TECHNICAL FIELD

The present invention relates to a nonwoven fabric substrate for wiping sheet.

BACKGROUND ART

As a substrate used in a wiping sheet, for example, Patent Literature 1 discloses a rectangular nonwoven fabric which includes a high-fiber density region and a low-fiber density region as a wet type cleaning sheet, each of the high-fiber density region and the low-fiber density region being formed in a shape in which a V shape is repeated in a lateral direction.

In general, the cleaning sheet has a rectangular shape, and, for example, when dirt on a table is cleaned while directly having the cleaning sheet by hand, the rectangular cleaning sheet is folded in a rectangular shape such as two-fold or four-fold to perform cleaning in a folded state. Moreover, when the cleaning sheet becomes dirty, it is turned inside out and folded again in a rectangular shape, thereby always performing cleaning with a clean surface.

When the nonwoven fabric described in Patent Literature 1 is used in the cleaning sheet, since each of the high-fiber density region and the low-fiber density region is formed in a shape in which a V shape is repeated in the lateral direction, the V-shaped high-fiber density region always obliquely touches against the dirt on the table, and the wiping residue is less likely to occur.

CITATION LIST

Patent Literature

Patent Literature 1: JP 2002-30557 A

SUMMARY OF INVENTION

However, according to the nonwoven fabric described in Patent Literature 1, since each of the high-fiber density region and the low-fiber density region is formed in a shape in which the V shape is repeated in the lateral direction, when being folded in a rectangular shape, in some cases, the V-shaped high-fiber density region enters the V-shaped low-fiber density region, and it is difficult to obtain a sense of thickness.

Furthermore, since the nonwoven fabric described in Patent Literature 1 has apertures, it is possible to wipe off a granular solid waste, or it is possible to peel off the stuck dirt by ridges of the high-fiber density region, and to wipe off the peeled dirt by the apertures. However, since the apertures of the nonwoven fabric described in Patent Literature 1 are simply arranged evenly along the low-fiber density region, it is not possible to sufficiently absorb the liquid dirt.

Therefore, according to the invention, there is provided a nonwoven fabric substrate for wiping sheet capable of solving the above-mentioned problems.

The invention relates to a nonwoven fabric substrate for wiping sheet in which ridges and grooves are alternately formed at positions corresponding to each other on each of both sides, and apertures passing through the grooves of both sides are formed. The ridges and the grooves extend parallel to each other, and extend in a direction intersecting with each of a pair of both sides extending in parallel of the nonwoven fabric substrate for wiping sheet. In planar view, each of the grooves alternately includes an aperture portion which has a plurality of the apertures, and a non-aperture portion which has no apertures and is longer than a distance between the nearest end portions of the adjacent apertures of the aperture portion, and an arrangement pattern of the aperture portion and the non-aperture portion provided in the groove is different from an arrangement pattern of the aperture portion and the non-aperture portion provided in the groove adjacent to the groove. When the whole of the nonwoven fabric substrate for wiping sheet is seen in planar view, the substrate has an aperture region formed by the aperture portions of the plurality of grooves, and a non-aperture region formed by the non-aperture portions of the plurality of grooves. Each of the aperture region and the non-aperture region are arranged in a predetermined pattern.

DESCRIPTION OF EMBODIMENTS

Figure 1:
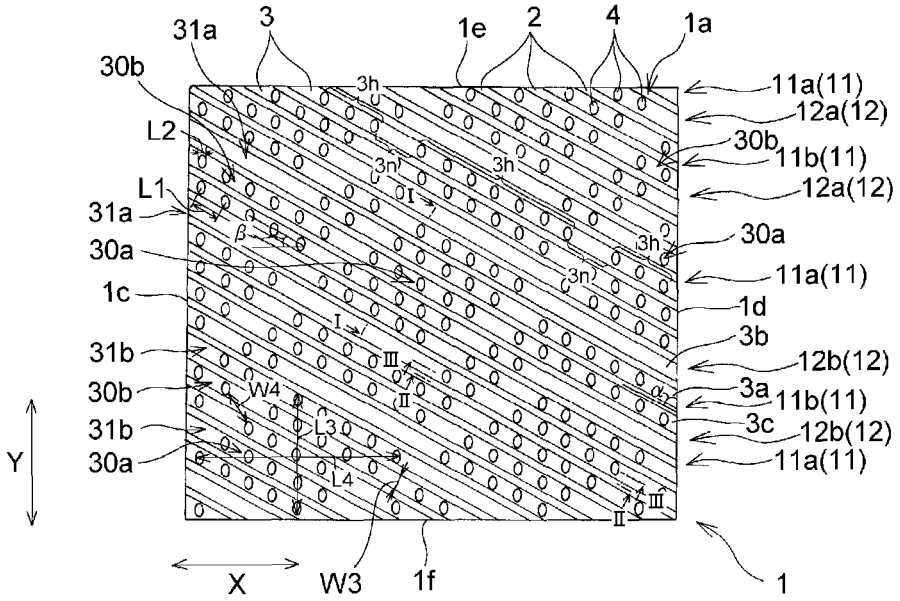
FIG. 1 is a plan view illustrating an embodiment of a nonwoven fabric substrate for wiping sheet of the invention.
Figure 2:
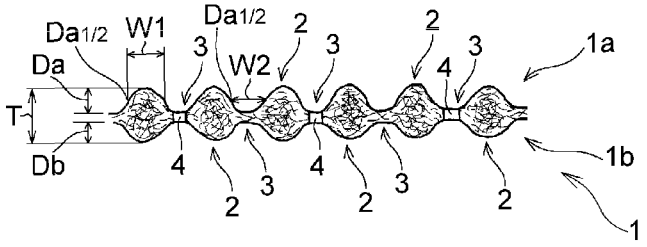
FIG. 2 is a cross-sectional view taken along line I-I of FIG. 1.

Hereinafter, a nonwoven fabric substrate for wiping sheet of the invention will be described with reference to the drawings based on the preferred embodiments. FIG. 1 illustrates a plan view of an embodiment of the nonwoven fabric substrate for wiping sheet of the invention. FIG. 2 illustrates a cross-sectional view taken along line I-I orthogonal to each of the extending directions of ridges 2 and grooves 3 illustrated in FIG. 1. Furthermore, FIG. 3(*a*) illustrates a cross-sectional view taken along line II-II illustrated in FIG. 1, and FIG. 3(*b*) illustrates a cross-sectional view taken along line III-III illustrated in FIG. 1.

A nonwoven fabric substrate 1 for wiping sheet (hereinafter, also referred to as a nonwoven fabric substrate 1) of the present embodiment is intended to be used as a wiping sheet with which a chemical solution is to be impregnated. In the following description, a so-called dry type nonwoven fabric substrate 1 in which the chemical solution is not yet impregnated will be described first.

As illustrated in FIG. 2, the nonwoven fabric substrate 1 has a first surface 1*a*, and a second surface 1*b* which is located on an opposite side to the first surface 1*a*. When the nonwoven fabric substrate 1 is used, for example, as a cleaning sheet on the table, both of the first surface 1*a* or the second surface 1*b* can be used as the cleaning surface toward a table surface side. As illustrated in FIG. 2, in the nonwoven fabric substrate 1, the ridges 2 and the grooves 3 are alternately formed at positions corresponding to each other on each of both sides 1*a* and 1*b*, respectively. Here, the term "formed at the positions corresponding to each other" means that the position where the ridges 2 and the grooves 3 of the first surface 1*a* are arranged is consistent with the position where the ridges 2 and the grooves 3 of the second surface 1*b* are arranged, respectively. The ridges 2 and the grooves 3 of both sides 1*a* and 1*b* extend parallel to each other, and extend in a direction intersecting with each of a pair of both sides 1*c* and 1*d* extending in parallel of the nonwoven fabric substrate 1. As illustrated in FIG. 1, the nonwoven fabric substrate 1 of the present embodiment is rectangular, each of the four sides is a straight line, and the nonwoven fabric substrate 1 includes a pair of left and right lateral sides 1*c* and 1*d* extending in parallel, and a pair of upper and lower end sides le and if extending in parallel. The lateral sides 1*c* and 1*d* and the end sides 1*e* and if intersect perpendicularly with each other. In this way, each of the four sides in the nonwoven fabric substrate 1 is a straight line, but in the nonwoven fabric substrate for wiping sheet of the present embodiment, at least a pair of both sides of the pair of both sides 1*c* and 16*d* and the pair of both sides 1*e* and 1*f* extending in parallel may be a straight line, and each of a pair of both sides and the extending directions of each of the ridges 2 and the grooves 3 may be in an intersection relation. Hereinafter, the description will be given on the assumption that the extending direction of the left and right lateral sides 1*c* and 1*d* is a Y direction, and a direction (extending direction of the upper and lower end sides 1*e* and 1*f*) orthogonal to the Y direction is an X direction.

As illustrated in FIG. 1, the ridges 2 and the grooves 3 of the first surface 1*a* are alternately arranged over the entire first surface 1*a*, and extend parallel to each other. As illustrated in FIG. 1, each of the ridges 2 and the grooves 3 and each of the pair of both sides 1*c* and 1*d* extending in parallel intersect at an angle α. From the viewpoint of the wiping characteristics, the angle α is preferably 30° or more, more preferably 45° or more, and preferably 80° or less. For example, the angle is preferably 30° or more and 80° or less, and more preferably 45° or more and 80° or less.

Figure 3A:
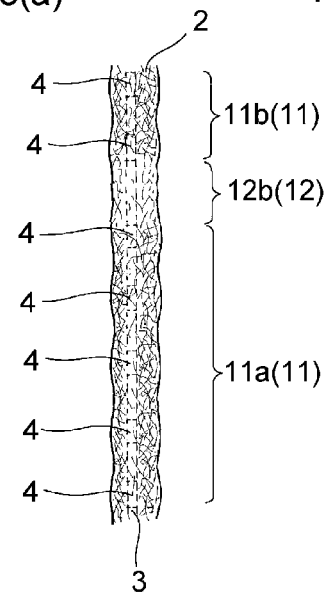
FIG. 3(*a*) is a cross-sectional view taken along line II-II of FIG. 1, and FIG. 3(*b*) is a cross-sectional view taken along line III-III of FIG. 1.
Figure 3B:
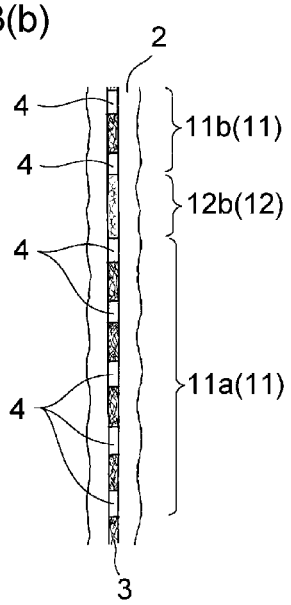

In detail, in cross-sectional view as illustrated in FIG. 2, each of the ridges 2 on the side of the first surface 1*a* has a contour drawing an upward convex curve, each of the ridges 2 having the same shape and the same size is arranged substantially at equal intervals in the lateral direction. As illustrated in FIG. 3(*a*), in each of the ridges 2 on the side of the first surface 1*a*, the thickness of the ridges 2 is substantially the same at any position in the extending direction. As illustrated in FIG. 2, each of the grooves 3 on the side of the first surface 1*a* is formed between the ridges 2 adjacent to each other in the lateral direction. Here, although a clear boundary between the ridges 2 and the grooves 3 is not present, when the boundary is clearly defined, for example, as an example of the first surface 1*a* side, a position $D_{a1/2}$ of ½ of a height difference $D_a$ at the top of the ridge 2 (a distance between the top of the ridge 2 and the bottom of the groove (excluding a portion formed by the apertures 4 of the grooves 3 described below)) is set to a boundary between the ridges 2 and the grooves 3 (see FIG. 2).

Furthermore, in cross-sectional view as illustrated in FIG. 2, each of the ridges 2 on the side of the second surface 1*b* is lower than the ridges 2 on the side of the first surface 1*a*, but has a contour drawing a downward convex curve, and each of the ridges 2 having the same shape and size is arranged substantially at equal intervals in the lateral direction. Similarly to each ridge 2 on the side of the first surface 1*a*, as illustrated in FIG. 3(*a*), in each ridge 2 on the side of the second surface 1*b*, the thickness of the ridges 2 is substantially the same at any position in the extending direction. Similarly to the ridges 2 of the side of the first surface 1*a*, each groove 3 on the side of the second surface 1*b* is also formed between the ridges 2 adjacent to each other in the lateral direction. Therefore, in cross-sectional view as illustrated in FIG. 2, the nonwoven fabric substrate 1 has a shape in which the thickness changes periodically in the lateral direction. Additionally, for example, as an example of the side of the first surface 1*a*, the thickness (height) of the ridges 2 on each side of the first surface 1*a* and the second surface 1*b* means the distance between the above-mentioned "position $D_{a1/2}$ of ½ of the height difference $D_a$ at the top of the ridge 2" and the top of the ridge 2.

When the nonwoven fabric substrate 1 is used as the wiping sheet, the total length thereof in the Y direction is preferably 100 mm or more and 300 mm or less, and the total length thereof in the X direction is preferably 100 mm or more and 300 mm or less.

From the viewpoint of the maintenance of bulky feeling during use and the scraping characteristics of dirt, a width W1 (see FIG. 2) of each ridge 2 of the nonwoven fabric substrate 1 in the lateral direction is preferably 0.5 mm or more, more preferably 0.8 mm or more, and even more preferably 3.0 mm or less. For example, the width W1 is preferably 0.5 mm or more and 3.0 mm or less, and more preferably 0 8 mm or more and 3.0 mm or less.

Furthermore, from the viewpoint of retention of the removed dirt, a width W2 (see FIG. 2) of each groove 3 of the nonwoven fabric substrate 1 in the lateral direction is preferably 2.0 mm or more, and more preferably 2.2 mm or more. Furthermore, the width W2 is preferably 6.0 mm or less, and more preferably 5.5 mm or less. For example, the width W2 is preferably 2.0 mm or more and 6 0 mm or less, and more preferably 2.2 mm or more and 5.5 mm or less.

From the viewpoint of maintenance of bulky feeling during use, the thickness T (see FIG. 2) of the nonwoven fabric substrate 1, that is, the distance between the top of the convex ridge 2 on the first surface 1*a* and the top of the convex ridge 2 below the second surface 1*b* is preferably 0.3 mm or more, and more preferably 0.5 mm or more. Furthermore, the distance is preferably 2.5 mm or less, and more preferably 2.0 mm or less. For example, the distance is preferably 0.3 mm or more and 2 5 mm or less, and more preferably 0.5 mm or more and 2.0 mm or less. The thickness T of the nonwoven fabric substrate 1 is measured based on the "thickness measurement of textiles and textile products" according to JIS L 1096 in the state prior to impregnating the chemical solution, and is measured under a load of 0.3 kPa, for example, using a DAIEI KAGAKU SEIKI MFG CO., LTD. (model FS-60DS). The load corresponds to the pressure when lightly pressing the nonwoven fabric substrate 1 by hand.

Furthermore, a ratio of the thickness T to the width W2 of the groove 3 is preferably between 1:0.8 to 1:20, and more preferably between 1:1.1 to 1:11.

From the viewpoint of dirt retention in the groove portion, the height difference $D_a$ (see FIG. 2) at the top of the ridge 2 of the first surface 1*a* side is preferably 0.2 mm or more, preferably 1.2 mm or less, and more preferably 1.0 mm or less. For example, the height difference $D_a$ is preferably 0.2 mm or more and 1.2 mm or less, and more preferably 0.2 mm or more and 1.0 mm or less.

Furthermore, from the same viewpoint, the height difference $D_b$ (see FIG. 2) at the top of the ridge 2 of the second surface 1*b* side is preferably 0.1 mm or more, preferably 1.2 mm or less, and more preferably 1.0 mm or less. For example, the height difference $D_b$ is preferably 0.1 mm or more and 1.2 mm or less, and more preferably 0.1 mm or more and 1.0 mm or less.

The height differences $D_a$ and $D_b$ are measured by magnifying the cross section of the nonwoven fabric substrate 1 to 50 times to 200 times using a device (microscope VH-8000) manufactured by KEYENCE CORPORATION. The cross section is obtained by cutting the nonwoven fabric substrate 1 across the X direction using a feather razor (model No. FAS-10 manufactured by FEATHER SAFETY RAZOR CO., LTD.).

The ratio of the thickness T to the height difference $D_a$ is preferably between 1:0.08 to 1:0.67, and more preferably between 1:0.1 to 1:0.5.

Furthermore, the ratio of thickness T to the height difference $D_b$ is preferably between 1:0.04 to 1:0.67, and more preferably between 1:0.05 to 1:0.5.

In the nonwoven fabric substrate 1, as illustrated in FIGS. 1 and 2, apertures 4 penetrating the grooves 3 on both sides 1*a* and 1*b* are formed. As illustrated in FIG. 1, in planar view, each groove 3 alternately includes an aperture portion 3*h* having the apertures 4, and a non-aperture portion 3*n* having no aperture 4. Specifically describing with reference to the nonwoven fabric substrate 1, as illustrated in FIG. 1, each groove 3 alternately includes the aperture portion 3*h* and the non-aperture portion 3*n* in the extending direction of the grooves 3, and the aperture portion 3*h* has one to seven apertures 4. Among the plurality of aperture portions 3*h* included in one groove 3, in particular, in the aperture portion 3*h* having a plurality (two or more) of apertures 4, the apertures 4 are arranged at equal intervals in the extending direction of the grooves 3.

Each aperture 4 is formed by dividing and rearranging the constituent fibers of the nonwoven fabric substrate 1. In other words, in the vicinity of the peripheral portion of the apertures 4, a film-like structure due to thermal deformation of the fiber is not formed. The apertures 4 may take various shapes in planar view. As the shape of the apertures 4 in planar view, for example, shapes such as a circle, an oval, an ellipse, a triangle, a quadrangle, and a hexagon, a shape of the combination thereof and the like are adopted.

From the viewpoint of sheet strength and flexibility, a distance L1 (see FIG. 1) between the adjacent apertures 4 in the extending direction of the grooves 3 is preferably 4.0 mm or more, preferably 15.0 mm or less, and more preferably 8.0 mm or less. For example, the distance L1 is preferably 4.0 mm or more and 15.0 mm or less, and more preferably 4.0 mm or more and 8.0 mm or less.

From the viewpoint of the capture of the solid waste and the liquid discharge, a diameter L2 (a distance between the narrowest positions) (see FIG. 1) of each aperture 4 is preferably 0.7 mm or more, more preferably, 0.75 mm or more, preferably 3.0 mm or less, and more preferably 2.70 mm or less. For example, the diameter L2 is preferably 0.7 mm or more and 3.0 mm or less, and more preferably 0.75 mm or more and 2.70 mm or less.

From the viewpoint of sheet strength and flexibility, the ratio (L2×100/W2) of the diameter L2 (see FIG. 1) of the apertures 4 in the width W2 (see FIG. 2) of the grooves 3 is preferably 20% or more, more preferably 30% or more, and preferably 90% or less. Furthermore, the ratio is preferably 20% or more and 90% or less, and more preferably 30% or more and 90% or less.

When the size of each aperture 4 is expressed in a projected area of the nonwoven fabric substrate 1 in planar view, from the viewpoint of the capture of solid waste and the liquid discharge, the size is preferably 0.5 $mm^2$ or more, more preferably 1 $mm^2$ or more, and preferably 10 $mm^2$ or less. For example, the size is preferably 0.5 $mm^2$ or more and 10 $mm^2$ or less, and more preferably 1 $mm^2$ or more and 10 $mm^2$ or less. The size of the aperture 4 is measured using an image analysis system.

Specifically, an image of the nonwoven fabric substrate 1 is captured by the use of a light source [sunlight SL-230K2; manufactured by LPL CO., LTD.], a stand [copy stand CS-5; manufactured by LPL CO., LTD.], a lens [NIKKOR 24 mm F2.8D], a CCD camera [connected with a lens using an F mount (HV-37; manufactured by HITACHI ELECTRONICS , LTD.)], and a video board [Spectra 3200; manufactured by CANOPUS Co., LTD.], and in the captured image, the portion of the aperture 4 is binarized by an image analysis software NEW QUBE (ver. 4.20) manufactured by NEXUS Corporation. An average value of the individual areas obtained from the binarized image is set to the size of the aperture 4.

The length of the non-aperture portion 3*n* in the extending direction of the grooves 3 is longer than the distance between the nearest end portions of the adjacent apertures 4 in the extending direction of the grooves 3 in the aperture portion 3*h*. That is, the interval between the apertures 4 of the aperture portion 3*h* arranged on both sides of the non-aperture portion 3*n* is longer than the interval between the adjacent apertures 4 in the aperture portion 3*h*.

In the nonwoven fabric substrate 1, an arrangement pattern of the aperture portion 3*h* and the non-aperture portion 3*n* provided in one groove 3 is different from an arrangement pattern of the aperture portion 3*h* and the non-aperture portion 3*n* provided in another groove 3 adjacent to the groove 3. Hereinafter, the nonwoven fabric substrate 1 will be specifically described. For example, considering a certain groove 3*a* illustrated in FIG. 1, the groove 3*a* has an arrangement pattern arranged in the order of the aperture portion 3*h* of the six apertures 4, the non-aperture portion 3*n*, the aperture portion 3*h* of the five apertures 4, the non-aperture portion 3*n*, and the aperture portion 3*h* of the two apertures 4, and the non-aperture portion 3*n*, from the right side ld in the X direction to the left side 1*c*. Furthermore, as illustrated in FIG. 1, a groove 3*b* adjacent to the upper side of the groove 3*a* in the Y direction has an arrangement pattern arranged in the order of the non-aperture portion 3*n*, the aperture portion 3*h* of the five apertures 4, the non-aperture portion 3*n*, the aperture portion 3*h* of the two apertures 4, the non-aperture portion 3*n*, and the aperture portion 3*h* of the five apertures 4, from the right side 1*d* in the X direction to the left side 1*c*. Furthermore, as illustrated in FIG. 1, a groove 3*c* adjacent to the lower side of the groove 3*a* in the Y direction has an arrangement pattern arranged in the order of the aperture portion 3*h* of the seven apertures 4, the non-aperture portion 3*n*, the aperture portion 3*h* of the five apertures 4, the non-aperture portion 3*n*, and the aperture portion 3*h* of the six apertures 4, from the right side 1*d* in the X direction to the left side 1*c*. In this way, the arrangement pattern of the aperture portion 3*h* and the non-aperture portion 3*n* provided in the groove 3*a* is different from the arrangement pattern of the aperture portion 3*h* and the non-aperture portion 3*n* provided in the grooves 3*b* and 3*c* adjacent to each of the upper side and the lower side in the Y direction of the groove 3*a*.

When the whole of the nonwoven fabric substrate 1 is seen in planar view, the nonwoven fabric substrate 1 has an aperture region 11 formed by the aperture portion 3*h* of a plurality of the grooves 3, and a non-aperture region 12 formed by the non-aperture portion 3*n* of a plurality of the grooves 3, and each of the aperture region 11 and the non-aperture region 12 is arranged in a predetermined pattern. For example, in the extending direction (X direction) of the aperture region, the aperture regions 11 are arranged in a pattern in which a particular shape such as a diamond shape or a V shape is periodically repeated. Furthermore, in the extending direction (X-direction) of the non-aperture regions 12, the non-aperture regions 12 are arranged in a pattern in which a particular shape such as a V shape is periodically repeated. Hereinafter, the nonwoven fabric substrate 1 will be specifically described. As illustrated in FIG. 1, when the whole of the nonwoven fabric substrate 1 is seen in planar view, the aperture region 11 includes a first aperture region 11*a* in which diamond-shaped aperture regions 30*a* formed by the aperture portion 3*h* of the plurality of grooves 3 are arranged at regular intervals in the X direction, and a second aperture region 11*b* in which V-shaped aperture regions 30*b* formed by the aperture portion 3*h* of the plurality of grooves 3 are repeatedly arranged in the X direction, and the nonwoven fabric substrate 1 has a pattern in which the first aperture region 11*a* and the second aperture region 11*b* are alternately arranged at regular intervals in the Y direction. More specifically, the nonwoven fabric substrate 1 has a pattern in which one second aperture region 11*b*, and another second aperture region 11*b* adjacent to the Y direction of the second aperture region 11*b* are shifted in the X direction by a half pitch, and the diamond-shaped aperture region 30*a* of the first aperture region 11*a* is arranged between the V-shaped aperture region 30*b* of the second aperture region 11*b* and a reverse V-shaped second aperture region 11*b* adjacent to the Y direction shifted to the second aperture region 11*b* by a half pitch, respectively. Thus, the aperture regions 11 are arranged repeatedly with the non-aperture region 12 interposed therebetween in the direction (Y direction) orthogonal to the extending direction (X direction) of the aperture region, and in the adjacent aperture regions 11 in the Y direction having a particular shape such as a diamond shape or a V shape, the period of the particular shape is shifted by a half pitch. The non-aperture regions 12 are arranged with the aperture region 11 interposed therebetween in the direction (Y direction) orthogonal to the extending direction (X direction) of the non-aperture region, and in the non-aperture regions 12 having a particular shape such as a V shape, the period of the particular shape is shifted by a half pitch from at least one of other non-aperture regions 12 adjacent to each other in the Y direction.

From the viewpoint of absorbency of liquid, strength of the nonwoven fabric, and flexibility, a length L3 (see FIG. 1) of the aperture region 30*a* forming the first aperture region 11*a* in the Y direction is preferably 20 mm or more, and more preferably 25 mm or more. Furthermore, the length L3 is preferably 110 mm or less, and more preferably 100 mm or less. For example, the length is preferably 20 mm or more and 110 mm or less, and more preferably 25 mm or more and 100 mm or less. In addition, a length L4 (see FIG. 1) in the X direction is preferably 20 mm or more, and more preferably 25 mm or more. Furthermore, the length is preferably 60 mm or less, and more preferably 50 mm or less. For example, the length is preferably 20 mm or more and 60 mm or less, and more preferably 25 mm or more and 50 mm or less.

The V-shaped aperture region 30*b* forming the second aperture region 11*b* is formed in a constant width. From the viewpoint of collecting characteristics of the solid dirt, strength of the nonwoven fabric, and flexibility, a width W3 (see FIG. 1) of the aperture region 30*b* is preferably 8 mm or more, preferably 20 mm or less, and more preferably 15 mm or less. For example, the width W3 is preferably 8 mm or more and 20 mm or less, and more preferably 8 mm or more and 15 mm or less. One side forming the V-shaped aperture region 30*b* extends to form an angle β (see FIG. 1) between the one side and a straight line extending in the X direction. The angle β is preferably 10° or more and 40° or less. The other side forming the V-shaped aperture region 30*b* is formed by inverting the one side symmetrically relative to the line extending in the Y direction. The V-shaped aperture region 30*b* formed in this way are arranged repeatedly in the X direction, and the second aperture regions l 1*b* is formed in a jagged shape such as saw teeth extending in the X direction.

As described above, the nonwoven fabric substrate 1 has a pattern in which the first aperture region 11*a* and the second aperture region 11*b* are alternately arranged at a regular interval in the Y direction, and the regular interval is the non-aperture region 12 formed by the non-aperture portion 3*n* of the plurality of grooves 3. In this manner, as illustrated in FIG. 1, the non-aperture region 12 is arranged every interval between the first aperture region 11*a* in which the plurality of diamond-shaped aperture regions 30*a* are arranged in the X direction, and the second aperture region 11*b* in which the V-shaped aperture regions 30*b* are repeatedly arranged in the X direction. In order to surround each of the diamond-shaped aperture regions 30a of the first aperture regions 11*a*, the non-aperture region 12 of the nonwoven fabric substrate 1 includes a first non-aperture region 12*a* in which the V-shaped non-aperture regions 31*a* formed by the non-aperture portion 3*n* of the plurality of grooves 3 are repeatedly arranged in the X direction, and a second non-aperture regions 12*b* in which the inverted V-shaped non-aperture regions 31*b* formed by the non-aperture portion 3*n* of the plurality of grooves 3 are repeatedly arranged in the X direction. The second non-aperture region 12*b* has a shape obtained by inverting the first non-aperture region 12*a* symmetrically relative to the bisector extending in the X direction of the diamond-shaped aperture region 30*a*. In other words, the first non-aperture region 12*a* and the second non-aperture region 12*b* are shifted in the X direction by a half pitch. Similarly to one side forming the V-shaped aperture region 30*b*, one side of the V-shaped non-aperture region 31*a* forming the first non-aperture region 12*a* extends to form the angle β (see FIG. 1) between the one side and the straight line extending in the X direction. The other side forming the V-shaped non-aperture region 31*a* is formed by inverting the one side symmetrically relative to the line extending in the Y direction. In the first non-aperture region 12*a*, the V-shaped non-aperture regions 31*a* formed in this way are repeatedly arranged in the X direction, and as in the second aperture region 11*b*, the first non-aperture region 12*a* is formed in a jagged shape such as the saw teeth extending in the X direction. Similarly to the first non-aperture region 12*a*, in the second non-aperture region 12*b*, the inverted V-shaped non-aperture regions 31*b* are also repeatedly arranged in the X direction, and the second non-aperture regions 12*b* is formed in a jagged shape such as the saw teeth extending in the X direction.

In the first non-aperture region 12*a* and the second non-aperture region 12*b*, a width W4 thereof is formed in the same width. Thus, each of the first non-aperture region 12*a* and the second non-aperture region 12*b* are formed in the regular width W4. The width W4 is formed to be wider than the interval L1 (see FIG. 1) between the apertures 4 adjacent to each other in the extending direction of the grooves 3. In order to sufficiently absorb the liquid dirt in the case that the nonwoven fabric substrate 1 is used as a wet type wiping sheet, and from the viewpoint of strength of the nonwoven fabric and flexibility, the width W4 is preferably 5 mm or more, more preferably 10 mm or more, and preferably 20 mm or less. For example, the width W4 is preferably 5 mm or more and 20 mm or less, and more preferably 10 mm or more and 20 mm or less.

In the nonwoven fabric substrate 1, each of the aperture region 11 (11*a*, 11*b*) and the non-aperture region 12 (12*a*, 12*b*) is arranged in a pattern in which each of the extending direction of the aperture region 11 (11*a*, 11*b*) and the extending direction of the non-aperture region 12 (12*a*, 12*b*) intersects with the extending direction of each of the ridges 2 and the grooves 3. Specifically, the aperture region 11 including the first aperture region 11*a* and the second aperture region 11*b* extends in the X direction, the non-aperture region 12 including the first non-aperture region 12*a* and the second non-aperture region 12*b* also extends in the X direction, and each of the aperture region 11 and the non-aperture region 12 intersects with the extending direction of each of the ridges 2 and the grooves 3.

From the viewpoint of flexibility and strength of the nonwoven fabric, a basis weight (also including the apertures 4) as a whole of the nonwoven fabric substrate 1 is preferably 30 g/m$^2$ or more, and more preferably 40 g/m$^2$ or more. Furthermore, the basis weight is preferably 250 g/m$^2$ or less, and more preferably 100 g/m$^2$ or less. For example, the basis weight is preferably 30 g/m$^2$ or more and 250 g/m$^2$ or less, and more preferably 40 g/m$^2$ or more and 100 g/m$^2$ or less. In the ridges 2 and the grooves 3, the basis weights are different in order to improve wiping characteristics and the retention by hand. In other words, amounts of fiber are different between the ridges 2 and the grooves 3. Specifically, the ridges 2 have larger amount of fiber than the grooves 3. When expressing the amount of fiber of the ridges 2 and the grooves 3 by the basis weight, from the viewpoint of maintenance of the bulky feeling during use, scraping characteristics of dirt, and maintenance of the grip feeling of finger, the basis weight of the ridges 2 is preferably 50 g/m$^2$ or more, preferably 500 g/m$^2$ or less, and more preferably 200 g/m$^2$ or less. In addition, for example, the basis weight of the ridges 2 is preferably 50*g* /m$^2$ or more and 500 g/m$^2$ or less, and more preferably 50 g/m$^2$ or more and 200 g/m$^2$ or less. Meanwhile, from the viewpoint of strength or flexibility of nonwoven fabric, and absorbency of liquid, the basis weight (but excluding the apertures 4) of the grooves 3 is preferably 20 g/m$^2$ or more, and more preferably 30 g/m$^2$ or more. Furthermore, the basis weight of the grooves 3 is preferably 200 g/m$^2$ or less, and more preferably 90 g/m$^2$ or less. In addition, for example, the basis weight of the grooves 3 is preferably 20 g/m$^2$ or more and 200 g/m$^2$ or less, and more preferably 30 g/m$^2$ or more and 90 g/m$^2$ or less. An area of the grooves 3 including the apertures 4 and an area of the apertures 4 are required to calculate the basis weight of the grooves 3, but the area of the grooves 3 including the apertures 4 and the area of the apertures 4 can be measured using the above-mentioned image analysis apparatus or the like.

As illustrated in FIG. 3(*a*), when focusing on one ridge 2, fiber densities are different between a region in which the ridge 2 intersects with the aperture region 11 (11*a*, 11*b*) and a region in which the ridge 2 intersects with the non-aperture region 12 (12*a*, 12*b*), and the region in which the ridge 2 intersects with the aperture region 11 (11*a*, 11*b*) has the higher fiber density than the region in which the ridge 2 intersects with the non-aperture region 12 (12*a*, 12*b*). From the viewpoint of the viewpoint of the maintenance of bulky feeling during use, scraping characteristics of dirt, and maintenance of grip feeling of a finger, the fiber density of the region in which the ridge 2 intersects with the aperture region 11 (11*a*, 11*b*) is preferably 60 g/m$^3$ or more, and more preferably 65 g/m$^3$ or more. Furthermore, the fiber density is preferably 500 g/m$^3$ or less, and more preferably 200 g/m$^3$ or less. In addition, for example, the fiber density is preferably 60 g/m$^3$ or more and 500 g/m$^3$ or less, and more preferably 65 g/m$^3$ or more and 200 g/m$^3$ or less. Meanwhile, from the viewpoint of strength of the nonwoven fabric or absorbency of liquid, the fiber density of the region in which the ridge 2 intersects with the non-aperture region 12 (12*a*, 12*b*) is preferably 40 g/m$^3$ or more, preferably 440 g/m$^3$ or less, and more preferably 150 g/m$^3$ or less. In addition, for example, the fiber density is preferably 40 g/m$^3$ or more and 440 g/m$^3$ or less, and more preferably 40 g/m$^3$ or more and 150 g/m$^3$ or less.

Next, when focusing on one groove 3, as illustrated in FIG. 3(*b*), the fiber densities are different between a region in which the groove 3 intersects with the aperture region 11 (11*a*, 11*b*) and a region in which the groove 3 intersects with the non-aperture region 12 (12*a*, 12*b*), and the region in which the groove 3 intersects with the aperture region 11 (11*a*, 11*b*) has the higher fiber density than the region in which the groove 3 intersects with the non-aperture region 12 (12*a*, 12*b*). From the viewpoint of maintenance of strength of the nonwoven fabric, the fiber density of the region in which the groove 3 intersects with the aperture region 11 (11*a*, 11*b*) is preferably 40 g/m$^3$ or more, preferably 210 g/m$^3$ or less, and more preferably 110 g/m$^3$ or less. In addition, for example, the fiber density is preferably 40 g/m$^3$ or more and 210 g/m$^3$ or less, and more preferably 40 g/m$^3$ or more and 110 g/m$^3$ or less. Meanwhile, from the viewpoint of strength of the nonwoven fabric or absorbency of liquid, the fiber density of the region in which the groove 3 intersects with the non-aperture region 12 (12*a*, 12*b*) is preferably 20 g/m$^3$ or more, and more preferably 25 g/m$^3$ or more. Furthermore, the fiber density is preferably 180 g/m$^3$ or less, and more preferably 90 g/m$^3$ or less. In addition, for example, the fiber density is preferably 20 g/m$^3$ or more and 180 g/m$^3$ or less, and more preferably 25 g/m$^3$ or more and 90 g/m$^3$ or less.

Examples of the fibers forming the nonwoven fabric substrate 1 include hydrophilic fibers such as rayon, cotton, and acrylic fibers, polyolefin such as polyethylene and polypropylene, polyester such as polyethylene terephthalate, and synthetic fibers formed of a thermoplastic polymeric material such as polyamide and the like. In addition, it is also possible to use core-sheath type composite fibers including the combination of the thermoplastic polymeric materials, and side-by-side composite fibers. The fineness of the hydrophilic fiber is preferably 1 dtex or more and 5 dtex or less from the viewpoint of collecting performance of dirt, strength of the nonwoven fabric, and flexibility. The fineness of the synthetic fiber is preferably 1 dtex or more and 5 dtex or less from the viewpoint of collecting performance of dirt, strength of the nonwoven fabric, and flexibility. The ratio of the hydrophilic fiber is preferably 30 mass % or more and 100 mass % or less in the constituent fibers of the nonwoven fabric substrate 1. The ratio of the synthetic fiber is preferably 0 mass % or more and 70 mass % or less in the constituent fibers of the nonwoven fabric substrate 1.

Next, preferred embodiments of a method of manufacturing the nonwoven fabric substrate for wiping sheet of the invention will be described with reference to FIG. 4 as an example of the case of manufacturing the nonwoven fabric substrate 1 described above.

Figure 4:
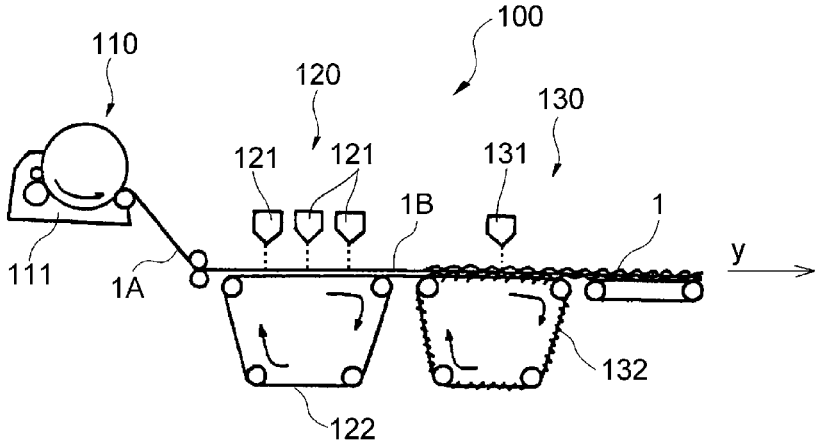
FIG. 4 is a schematic diagram illustrating a preferred apparatus for manufacturing the nonwoven fabric substrate for wiping sheet illustrated in FIG. 1.

FIG. 4 schematically illustrates a preferred apparatus 100 for manufacturing the nonwoven fabric substrate 1. The apparatus 100 includes a web forming portion 110, a hydroentanglement portion 120, and an aperture forming portion 130 from the upstream side toward the downstream side.

Furthermore, an arrow indicated by reference numeral y in FIG. 4 is a direction during manufacturing of the nonwoven fabric substrate 1, and is coincident with the MD direction along the orientation direction of the fibers.

The web forming portion 110 is equipped with a card machine 111. A card web 1A including the constituent fibers of the nonwoven fabric substrate 1 is sent from the card machine 111. Next, the sent card web 1A is conveyed to the hydroentanglement portion 120. The hydroentanglement portion 120 includes an injector 121 of a high-pressure jet water flow, and a permeable endless mesh belt 122. The endless mesh belt 122 is arranged at a position opposite to an injection port of the injector 121, and revolves in the y direction. The constituent fibers of the card web 1A are subjected to the hydroentanglement by the high-pressure jet water flow injected from the injector 121 and become a nonwoven fabric 1B. As the conditions at the time of performing the hydroentanglement of the card web 1A, it is possible to follow the conditions described in paragraph [0038] of JP 2008-202153 A.

Next, the obtained nonwoven fabric 1B is conveyed to the aperture forming portion 130. The aperture forming portion 130 is provided with an injector 131 of the high-pressure jet water flow, and an aperture member 132. The aperture member 132 is arranged at a position opposite to the injection port of the injector 131, and revolves in the y direction. For example, the aperture member 132 has a configuration in which, in a permeable endless belt, a net of mesh made of stainless steel or plastic which has an opening hole (hole portion) provided so as to correspond to the aperture region 11 (11*a*, 11*b*) and formed so as to correspond to the shape and size of the apertures 4 is provided. In addition, as the aperture member 132, instead of the net of mesh, a rotating roller having a plurality of convex portions provided so as to correspond to the aperture region 11 (11*a*, 11*b*) and formed so as to correspond to the shape and the size of the apertures 4 on the peripheral surface may be used.

In the aperture forming portion 130, under a state where the nonwoven fabric 1B is placed on the aperture member 132, the high-pressure jet water flow is injected toward the nonwoven fabric 1B from the injector 131. The nonwoven fabric 1B located in the aperture site (or the convex portion) in the aperture member 132 receives the water pressure of the high-pressure jet water flow under the state of being pressed against the aperture member 132. As a result, the division occurs by the constituent fiber located in aperture site (or the convex portion), the apertures 4 are formed, and the re-arrangement of the constituent fibers occurs. Accordingly, the ridges 2 extending in the y direction and the grooves 3 formed with the penetrating apertures 4 are alternately arranged, and it is possible to continuously manufacture the nonwoven fabric substrate 1 in which the aperture region 11 (11*a*, 11*b*) and the non-aperture region 12 (12*a*, 12*b*) are formed in a predetermined pattern. In addition, a hot air processing unit configured to perform hot-air treatment may be provided at the downstream side of the aperture forming portion 130. As described above, by using the net of mesh having the opening hole (hole portion) provided so as to correspond to the aperture region 11 (11*a*, 11*b*) and formed so as to correspond to the shape and the size of the apertures 4, or by using the rotating roller having the convex portion, the apertures 4 are reliably formed at a predetermined position, the constituent fibers are rearranged, and when focusing on one ridge 2 and groove 3, as illustrated in FIGS. 3(*a*) and 3(*b*), it is possible to form the portions having the different fiber densities. As the conditions of the high-pressure jet water flow to be injected into the nonwoven fabric 1B, it is possible to follow conditions described in paragraphs [0040] and [0041] of JP 2008-202153 A.

It is preferable that the nonwoven fabric substrate 1 manufactured in this manner be used as a wiping sheet impregnated with the chemical solution. The type of chemical solution to be impregnated can be suitably selected depending on the specific applications. For example, when used as a cleaning sheet, as the chemical solution, an aqueous cleaning agent may be used. In particular, the nonwoven fabric substrate 1 is effective to be used by impregnating or spraying the liquid such as an aqueous cleaning agent. Since the cleaning sheet 1 contains the cellulosic fibers having hydrophilicity by the amount described above, it is possible to maintain the aqueous cleaning agent in an amount sufficient for cleaning. Moreover, when the cleaning sheet 1 is used as a wet type sheet impregnated with the aqueous cleaning agent, in addition to mechanically scraping and eliminating the dirt of the surface to be cleaned, and the dirt swells or partly dissolves by the cleaning agent. Accordingly, the removal of dirt under the action of mechanical scraping is further improved. When used as the wet type sheet, the aqueous cleaning agent may be impregnated into the cleaning sheet 1 in advance or the aqueous cleaning agent may be sprayed to the dry type cleaning sheet 1, and the surface to be cleaned may be cleaned using the sprayed cleaning sheet 1. It is preferable that the aqueous cleaning agent impregnated into the cleaning sheet 1 or used in combination contain a surfactant, an alkaline agent, a water-soluble solvent, and a disinfectant using water as a medium. Furthermore, the aqueous cleaning agent preferably contains the disinfectant. Non-volatile residual components contained in the aqueous cleaning agent are preferably 10 wt % or less in terms of the finish characteristics after cleaning, and particularly, 5 wt % or less is preferable.

As the surfactants, any of anionic surfactant, nonionic surfactant, cationic surfactant, and amphoteric surfactant is used, and in particular, in terms of compatibility of the cleaning characteristics and the finish characteristics, nonionic surfactants such as polyoxyalkylene (alkylene oxide addition mole number of 1 to 20) alkyl (straight chain or branched chain having a carbon number of 8 to 22) ether, alkyl (straight chain or branched chain having a carbon number of 8 to 22) glycoside (average sugar condensation degree of 1 to 5), sorbitan fatty acid (straight chain or branched chain having a carbon number of 8 to 22) ester, and alkyl (straight chain or branched chain having a carbon number of 6 to 22) glyceryl ether, and amphoteric surfactants having alkyl carbon number of 8 to 24, such as alkyl carboxybetaine, alkyl sulfobetaine, alkyl hydroxy sulfobetaine, alkylamide carboxybetaine, alkylamide sulfobetaine, and alkylamide hydroxy sulfobetaine are preferably used. In particular, the surfactants are contained in an amount of preferably 0.05 wt % or more, preferably 2.0 wt % or less, more preferably 1.0 wt % or less, and for example, 0.05 wt % or more and 2.0 wt % or less, and particularly 0.05 wt % or more and 1.0 wt % or less in terms of the cleaning characteristics and the finish characteristics of the surface to be cleaned.

As the alkaline agent, hydroxide such as sodium hydroxide, carbonate such as sodium carbonate and potassium carbonate, alkaline sulfate such as sodium hydrogensulfate, phosphate such as first sodium phosphate, organic alkali metal salt such as sodium acetate and sodium succinate, alkanolamine such as ammonium, mono-, di- or triethanolamine, β-amino alkanol such as 2-amino-2-methyl-1-propanol, morpholine and the like are adopted. The content of the alkaline agent is preferably 1 wt % or less, and particularly 0.5 wt % or less in the aqueous cleaning agent from the viewpoint of preventing slimy to provide satisfactory touch. Since there is a case where the alkaline agent may swell the oil dirt to make the surface to be cleaned slippery, the blending amount thereof is preferably as small as possible, and may be zero.

As the water-soluble solvent, one or more kinds selected from monohydric alcohol, polyhydric alcohol, and derivatives thereof are preferred. In particular, from the viewpoint of solubility of the oil dirt, finish characteristics, and safety, ethanol, isopropyl alcohol, propanol, ethylene glycol monomethyl ether, propylene glycol monomethyl ether, propylene glycol, butanediol, 3-methyl-1,3-butanediol, hexylene glycol, glycerin and the like are preferred. In addition, from the viewpoint of imparting sanitization performance, ethanol, isopropyl alcohol, propanol and the like among these are preferred. It is preferable that the water-soluble solvent be contained in the aqueous cleaning agent, in an amount of preferably 1 wt % or more, preferably 50 wt % or less, more preferably 20 wt % or less, for example, 1 wt % or more and 50 wt % or less, particularly 1 wt % or more and 20 wt % or less, from the viewpoint of the reduction in smell and skin irritation.

As the disinfectant, hydrogen peroxide, hypochlorous acid, sodium hypochlorite, quaternary ammonium salt, sodium benzoate, p-sodium benzoate, benzyl alcohol, phenoxy ethanol, isothiazoline-based disinfectant, and the like are adopted. Particularly, from the viewpoint of formulation stability and sanitization performance, quaternary ammonium salt, phenoxyethanol, and the like are preferably used. It is preferable that the disinfectant be contained in the aqueous cleaning agent, in an amount of preferably 0.003 wt % or more, preferably 2 wt % or less, more preferably 1 wt % or less, for example, 0.003 wt % or more and 2 wt % or less, in particular, 0.003 wt % or more and 1 wt % or less, from the viewpoint of balance between the sanitization effect and the reduction of the skin irritation.

Furthermore, as the aqueous cleaning agent, it is possible to contain perfume, fungicide, coloring matter (dye and pigment), chelating agent, polishing agent, bleaching agent, and the like as needed.

It is preferable that water serving as the medium of the aqueous cleaning agent be contained in the aqueous cleaning agent, in an amount of preferably 50 wt % or more, more preferably 80 wt % or more, preferably 99.9 wt % or less, more preferably 99 wt % or less, for example, 50 wt % or more and 99.9 wt % or less, and in particular 80 wt % or more and 99 wt % or less, from the viewpoint of cleaning characteristics of the surface to be cleaned and finish characteristics.

Furthermore, oil may be used as the chemical solution. As the oil, at least one kind or more of mineral oil, synthetic oil, silicone oil, and wax is preferably contained. As the mineral oil, paraffinic hydrocarbon, naphthenic hydrocarbon, aromatic hydrocarbon, and the like are used. As the synthetic oil, alkylbenzene oil, polyolefin oil, polyglycol oil, and the like are used. As the silicone oil, chain dimethyl polysiloxane, cyclic dimethyl polysiloxane, methyl hydrogen polysiloxane, various modified silicone, or the like is used.

An amount of impregnation of the chemical solution to the nonwoven fabric substrate 1 is dependent on the specific applications, but is preferably 100% or more per unit weight of the nonwoven fabric substrate 1, more preferably 150% or more, preferably 700% or less, more preferably 400% or less, for example, preferably 100% or more and 700% or less, and more preferably of 150% or more and 400% or less.

When the nonwoven fabric substrate 1 is used as the cleaning sheet, the nonwoven fabric substrate 1 is not mounted on a cleaning tool that includes a handle connected to the head portion, but is used directly by hand. For example, the cleaning sheet can be used for wiping cleaning of the desktop such as top of the desk, a top of dining table, and a top of the table, a flooring, a wall, a ceiling, a glass, a mat, a mirror, furniture, home appliances, an outer wall of house, and a hard surface such as a body of an automobile.

When the nonwoven fabric substrate 1 is used as a wet type cleaning sheet by impregnating the chemical solution into the nonwoven fabric substrate 1, the ridges 2 and the grooves 3 extend parallel to each other, and extend in a direction intersecting with each of the pair of both sides 1*c* and 1*d* extending in parallel. Accordingly, for example, the ridges 2 are not parallel to the dirt on the top of the desk, and always obliquely come into contact with the dirt, and the wiping residue is less likely to occur. In addition, for example, even when the wiping sheet formed by the nonwoven fabric substrate 1 is folded in two or in four to be folded in a rectangular shape, the ridges 2 of the surface serving as the cleaning surface always obliquely come into contact with the dirt, and the wiping residue is less likely to occur.

Furthermore, the ridges 2 and the grooves 3 extend parallel to each other at positions corresponding to each of both sides 1*a* and 1*b*, and extend in a direction intersecting with each of the pair of both sides 1*c* and 1*d* extending in parallel. Accordingly, when the wiping sheet formed by the nonwoven fabric substrate 1 is folded in a rectangular shape, since the ridges 2 arranged on the surface serving as the opposite surface always intersect with each other, the ridges 2 arranged on one opposite surface do not enter the grooves 3 arranged on the other opposite surface, and the sense of thickness is improved.

Furthermore, as illustrated in FIG. 1 the nonwoven fabric substrate 1 has the apertures 4 passing through the grooves 3, and the wiping sheet formed by the nonwoven fabric substrate 1 is able to efficiently wipe off the granular solid waste by the apertures 4 or wipe off the dirt of the cleaning surface peeled off by the ridges 2 which are inclined obliquely. Furthermore, as illustrated in FIG. 1, the nonwoven fabric substrate 1 has a non-aperture region 12 extending in the X direction which includes a first non-aperture region 12*a* and a second non-aperture region 12*b* formed by the non-aperture portion 3*n* of the plurality of grooves 3, other than the aperture region 11 formed by the aperture portion 3*h* of the plurality of grooves 3. Accordingly, the wiping sheet formed by the nonwoven fabric substrate 1 is also able to sufficiently absorb the liquid dirt.

Furthermore, as illustrated in FIG. 1, in the nonwoven fabric substrate 1, the aperture region 11 formed by the aperture portion 3*h* of the plurality of grooves 3, and the non-aperture region 12 formed by the non-aperture portion 3*n* of the plurality of grooves 3 are arranged in a predetermined pattern. Accordingly, the wiping sheet formed by the nonwoven fabric substrate 1 generates a stiffness difference between the aperture region 11 and the non-aperture region 12, and familiarity of hand is satisfactory.

The invention is not limited to the above-described embodiment.

For example, in the nonwoven fabric substrate 1 as described above, as illustrated in FIGS. 1 and 2, although the apertures 4 penetrating the grooves 3 on both sides 1*a* and 1*b* are formed, the apertures may not be formed.

Furthermore, in the nonwoven fabric substrate 1 as described above, as illustrated in FIG. 1, the aperture region 11 formed by the first aperture region 11 a and the second aperture region 11*b* extends in the X direction, the non-aperture region 12 formed by the first non-aperture region 12*a* and the second non-aperture region 12*b* also extends in the X direction, and each of the aperture regions 11 and the non-aperture region 12 is arranged in a pattern intersecting with the extending directions of the ridges 2 and the grooves 3, respectively. However, the aperture region 11 and the non-aperture region 12 may be arranged in a pattern parallel to the extending directions of the ridges 2 and the grooves 3 without intersecting with the extending directions.

Furthermore, the nonwoven fabric substrate 1 of the embodiment is intended to be used as the wiping sheet with which the chemical solution is to be impregnated, but may also be used as a wiping sheet without being impregnated with the chemical solution. Furthermore, the wiping sheet impregnated with the chemical solution may be used as a wet type wiping sheet, and may be used as a dry type wiping sheet after drying.

In regard to the embodiment described above, the nonwoven fabric substrate for wiping sheet will be further disclosed below.

<1>

A nonwoven fabric substrate for wiping sheet in which ridges and grooves are alternately formed at positions corresponding to each other on each of both sides, and apertures penetrating the grooves of both sides are formed, wherein the ridges and the grooves extend parallel to each other, and extend in a direction intersecting with each of a pair of both sides extending in parallel of the nonwoven fabric substrate for wiping sheet, in planar view, each of the grooves alternately includes an aperture portion having the apertures and a non-aperture portion having no aperture, an arrangement pattern of the aperture portion and the non-aperture portion provided in the groove is different from an arrangement pattern of the aperture portion and the non-aperture portion provided in the groove adjacent to the groove, when a whole of the nonwoven fabric substrate for wiping sheet is seen in planar view, the nonwoven fabric substrate has an aperture region formed by the aperture portion of the plurality of grooves, and a non-aperture region formed by the non-aperture portion of the plurality of grooves, and each of the aperture region and the non-aperture region is arranged in a predetermined pattern.

<2>

The nonwoven fabric substrate for wiping sheet according to <1>, wherein each of the aperture region and the non-aperture region is arranged in a pattern in which each of an extending direction of the aperture region and an extending direction of the non-aperture region intersects with the extending direction of each of the ridges and the grooves.

<3>

The nonwoven fabric substrate for wiping sheet according to <1> or <2>, wherein the apertures are formed by dividing and rearranging constituent fibers of the nonwoven fabric substrate.

<4>

The nonwoven fabric substrate for wiping sheet according to any one of <1> to <3>, wherein the aperture regions are arranged in a pattern in which a particular shape is periodically repeated in the extending direction (X direction) of the aperture region.

<5>

The nonwoven fabric substrate for wiping sheet according to any one of <1> to <3>, wherein the aperture regions are arranged in a pattern in which a particular shape of a diamond shape or a V shape is periodically repeated in the extending direction (X direction) of the aperture region.

<6>

The nonwoven fabric substrate for wiping sheet according to any one of <1> to <5>, wherein the non-aperture regions are arranged in a pattern in which a particular shape is periodically repeated in the extending direction (X direction) of the non-aperture region.

<7>

The nonwoven fabric substrate for wiping sheet according to any one of <1> to <5>, wherein the non-aperture regions are arranged in a pattern in which a particular shape of a V shape is periodically repeated in the extending direction (X direction) of the non-aperture region.

<8>

The nonwoven fabric substrate for wiping sheet according to any one of <1> to <7>, wherein the aperture regions are arranged in a pattern in which a particular shape is periodically repeated in the extending direction (X direction) of the aperture region, and the aperture regions are repeatedly arranged with the non-aperture region interposed therebetween in a direction (Y direction) orthogonal to the extending direction of the aperture regions, and in the adjacent aperture regions having the particular shape, the period of the particular shape is shifted by a half pitch.

<9>

The nonwoven fabric substrate for wiping sheet according to any one of <1> to <7>, wherein the aperture regions are arranged in a pattern in which a particular shape of a diamond shape or a V shape is periodically repeated in the extending direction (X direction) of the aperture regions, and the aperture regions are repeatedly arranged with the non-aperture region interposed therebetween in a direction (Y direction) orthogonal to the extending direction of the aperture regions, and a period of the particular shape in the adjacent aperture regions having the same particular shape is shifted by a half pitch.

<10>

The nonwoven fabric substrate for wiping sheet according to any one of <1> to <9>, wherein the non-aperture regions are arranged in a pattern in which a particular shape is periodically repeated in the extending direction (X direction) of the non-aperture regions, and the non-aperture regions are repeatedly arranged with the aperture region interposed therebetween in a direction (Y direction) orthogonal to the extending direction of the non-aperture regions, and a period of the particular shape in the non-aperture region having the particular shape is shifted by a half pitch from at least one of the adjacent other non-aperture regions.

<11>

The nonwoven fabric substrate for wiping sheet according to any one of <1> to <10>, wherein the non-aperture regions are arranged in a pattern in which a particular shape of a V shape is periodically repeated in the extending direction (X direction) of the non-aperture regions, and the non-aperture regions are repeatedly arranged with the aperture region interposed therebetween in a direction (Y direction) orthogonal to the extending direction of the non-aperture regions, and the period of the particular shape in the non-aperture region having the particular shape is shifted by a half pitch from at least one of the adjacent other non-aperture regions.

<12>

The nonwoven fabric substrate for wiping sheet according to any one of <1> to <11>, wherein the non-aperture regions have a constant width in the extending direction of the non-aperture regions, and the width is wider than an interval between the apertures adjacent to each other in the direction of the grooves in the aperture portions.

<13>

The nonwoven fabric substrate for wiping sheet according to any one of <1> to <12>, wherein a lateral width of the ridges is 0.5 mm or more and 3.0 mm or less, or 0.8 mm or more and 3.0 mm or less.

<14>

The nonwoven fabric substrate for wiping sheet according to any one of <1> to <13>, wherein the lateral width of the ridges is 2.0 mm or more or 2.2 mm or more, or 6.0 mm or less or 5.5 mm or less.

<15>

The nonwoven fabric substrate for wiping sheet according to any one of <1> to <14>, wherein the interval between the apertures adjacent to each other in the extending direction of the grooves is 4.0 mm or more and 15.0 mm or less, or 4.0 mm or more and 8.0 mm or less.

<16>

The nonwoven fabric substrate for wiping sheet according to any one of <2> to <15>, wherein the diameter of the aperture is 0.7 mm or more or 0.75 mm or more, or 3.0 mm or less or 2.7 mm or less.

<17>

The nonwoven fabric substrate for wiping sheet according to <16>, wherein a ratio of the diameter of the aperture in the width of the grooves is 20% or more and 90% or less, or 30% or more and 90% or less.

<18>

The nonwoven fabric substrate for wiping sheet according to any one of <2> to <17>, wherein when expressed by a projected area of the nonwoven fabric substrate in planar view, the size of the aperture is 0.5 $mm^2$ or more and 10 $mm^2$ or less, or 1 $mm^2$ or more and 10 $mm^2$ or less.

<19>

The nonwoven fabric substrate for wiping sheet according to any one of <1> to <18>, wherein a basis weight of the nonwoven fabric substrate is 30 $g/m^2$ or more or 40 $g/m^2$ or more, or 250 $g/m^2$ or less or 100 $g/m^2$ or less.

<20>

The nonwoven fabric substrate for wiping sheet according to any one of <1> to <19>, wherein the basis weight of the ridges is 50 $g/m^2$ or more or 50 $g/m^2$ or more, or 500 $g/m^2$ or less or 200 $g/m^2$ or less.

<21>

The nonwoven fabric substrate for wiping sheet according to any one of <1> to <20>, wherein the basis weight of the grooves excluding the apertures is 20 $g/m^2$ or more or 30 $g/m^2$ or more, or 200 $g/m^2$ or less or 90 $g/m^2$ or less.

<22>

The nonwoven fabric substrate for wiping sheet according to any one of <1> to <21>, wherein the substrate is impregnated with a chemical solution.

<23>

The nonwoven fabric substrate for wiping sheet according to any one of <1> to <22>, wherein an impregnated amount of the chemical solution to the nonwoven fabric substrate is 100% or more or 150% or more, or 700% or less or 400% or less per unit weight of the nonwoven fabric substrate.

<24>

The nonwoven fabric substrate for wiping sheet according to any one of <1> to <23>, wherein the chemical solution is an aqueous cleaning agent. <25>

The nonwoven fabric substrate for wiping sheet according to <24>, wherein the aqueous cleaning agent contains a surfactant.

<26>

The nonwoven fabric substrate for wiping sheet according to <25>, wherein the surfactant is contained in the aqueous cleaning agent, in an amount of preferably 0.05 wt % or more, preferably 2.0 wt % or less, more preferably 1.0 wt % or less, for example, 0.05 wt % or more and 2.0 wt % or less, and particularly, 0.05 wt % or more and 1.0 wt % or less.

<27>

The nonwoven fabric substrate for wiping sheet according to any one of <24> to <26>, wherein the aqueous cleaning agent contains an alkaline agent.

<28>

The nonwoven fabric substrate for wiping sheet according to <27>, wherein the alkaline agent is contained in the aqueous cleaning agent, in an amount of 1 wt % or less, and preferably 0.5 wt % or less.

<29>

The nonwoven fabric substrate for wiping sheet according to any one of <24> to <27>, wherein the aqueous cleaning agent contains a water-soluble solvent.

<30>

The nonwoven fabric substrate for wiping sheet according to <29>, wherein the water-soluble solvent is contained in the aqueous cleaning agent, in an amount of preferably 1 wt % or more, preferably 50 wt % or less, more preferably 20 wt % or less, for example, 1 wt % or more and 50 wt % or less, and particularly, 1 wt % or more and 20 wt % or less.

<31>

The nonwoven fabric substrate for wiping sheet according to any one of <24> to <30>, wherein the aqueous cleaning agent contains a disinfectant.

<32>

The nonwoven fabric substrate for wiping sheet according to <31>, wherein the disinfectant is isothiazolin-based disinfectant.

<33>

The nonwoven fabric substrate for wiping sheet according to any one of <24> to <30>, containing the disinfectant other than polyhexamethylene biguanide or poly (hexamethylene) biguanide hydrochloride.

<34>

The nonwoven fabric substrate for wiping sheet according to any one of <31> to <33>, wherein the disinfectant is contained in the aqueous cleaning agent, in an amount of preferably 0.003 wt % or more, preferably 2.0 wt % or less, more preferably 1.0 wt % or less, for example, 0.003 wt % or more and 2 wt % or less, and particularly, 0.003 wt % or more and 1 wt % or less.

<35>

The nonwoven fabric substrate for wiping sheet according to any one of <24> to <34>, wherein a medium of the aqueous cleaning agent is water, and is contained in the aqueous cleaning agent, in an amount of preferably 50 wt % or more, preferably 80 wt % or more, preferably 99.9 wt % or less, more preferably 99 wt % or less, for example, 50 wt % or more and 99.9 wt % or less, and particularly, 80 wt % or more and 99 wt % or less.

<36>

The nonwoven fabric substrate for wiping sheet according to any one of <1> to <23>, wherein the chemical solution is selected from at least one of mineral oil, synthetic oil, silicone oil, and wax.

<37>

The nonwoven fabric substrate for wiping sheet according to any one of <1> to <36>, wherein the aperture regions include a first aperture region arranged in a pattern in which a diamond shape is periodically repeated, and a second aperture region arranged in a pattern in which a V shape is periodically repeated, in the extending direction of the aperture regions, and the first aperture region and the second aperture region have a pattern arranged alternately with the non-aperture region interposed therebetween in a direction orthogonal to the extending direction of the aperture regions.

<38>

The nonwoven fabric substrate for wiping sheet according to <37>, wherein in order to surround the diamond shape of the first aperture region, the non-aperture regions include a first non-aperture region in which the V shape formed by the non-aperture portion of the plurality of grooves is repeatedly arranged in the extending direction of the non-aperture region, and a second non-aperture region in which an inverted V shape formed by the non-aperture portion of the plurality of grooves is repeatedly arranged in the extending direction of the non-aperture region.

<39>

The nonwoven fabric substrate for wiping sheet according to <37> or <38>, wherein in the diamond shape forming the first aperture region, the length in the direction orthogonal to the extending direction of the aperture regions is preferably 20 mm or more, more preferably 25 mm or more, preferably 110 mm or less, and more preferably 100 mm or less.

<40>

The nonwoven fabric substrate for wiping sheet according to any one of <37> to <39>, wherein in the diamond shape forming the first aperture region, the length of the extending direction of the aperture regions is preferably 20 mm or more, more preferably 25 mm or more, preferably 60 mm or less, and more preferably 50 mm or less.

<41>

The nonwoven fabric substrate for wiping sheet according to any one of <37> to <40>, wherein the V shape forming the second aperture region is formed in a constant width, and the width of the shape is preferably 8 mm or more, preferably 20 mm or less, and more preferably 15 mm or less.

<42>

The nonwoven fabric substrate for wiping sheet according to any one of <37> to <41>, wherein an angle formed between one side forming the V shape in the second aperture region and a straight line extending in the extending direction of the aperture regions is 10° or more and 40° or less.

<43>

The nonwoven fabric substrate for wiping sheet according to any one of <38> to <42>, wherein the width of the first non-aperture region and the width of the second non-aperture region are formed in the same width.

<44>

The nonwoven fabric substrate for wiping sheet according to <43>, wherein the width of the first non-aperture region and the second non-aperture region is preferably 5 mm or more, more preferably 10 mm or more, and preferably 20 mm or less.

<45>

The nonwoven fabric substrate for wiping sheet according to any one of <1> to <44>, wherein an angle a formed by each of the pair of both sides extending in parallel with each of the ridges and the grooves is preferably 30° or more, more preferably 45° or more, and preferably 80° or less.

<46>

The nonwoven fabric substrate for wiping sheet according to any one of <1> to <45>, wherein the thickness of the nonwoven fabric substrate, that is, the distance between the top of the convex ridge on one surface and the top of the convex ridge below the other surface is preferably 0.3 mm or more, more preferably 0.5 mm or more, preferably 2.5 mm or less, and more preferably 2.0 mm or less.

<47>

The nonwoven fabric substrate for wiping sheet according to <46>, wherein a height difference at the top of the ridge of the one surface side is preferably 0.2 mm or more, preferably 1.2 mm or less, and more preferably 1.0 mm or less.

<48>

The nonwoven fabric substrate for wiping sheet according to <46> or <47>, wherein a height difference at the top of the ridge of the other surface side is preferably 0.1 mm or more, preferably 1.2 mm or less, and more preferably 1.0 mm or less.

EXAMPLE

Hereinafter, the invention will be described in more detail with reference to examples. However, the scope of the invention is not intended to be limited by the examples in any way.

Example 1

The nonwoven fabric substrate for wiping sheet illustrated in FIG. 1 was manufactured by the method illustrated in FIG. 4. The nonwoven fabric substrate was manufactured using rayon (2.2 dtex and fiber length 38 mm; 70 wt %) and polyester fiber (2.2 dtex and fiber length 38 mm; 30 wt %) as a raw material, and the basis weight thereof was 60 g/m$^2$. The manufactured nonwoven fabric substrate will be described in more detail. The angle α formed between the extending direction of the ridges and the grooves of the nonwoven fabric substrate and both sides of the nonwoven fabric substrate was 60°, the width W1 of each ridge was 2.0 mm, the width W2 of each groove was 3.2 mm, and the thickness T was 0.9 mm. The height difference $D_a$ at the top of the ridges of the first surface 1*a* side was 0.7 mm, and the height difference $D_b$ at the top of the ridges of the second surface 1*b* side was 0.2 mm. The interval L1 between the apertures 4 was 6.3 mm, the diameter L2 of the apertures 4 was 2.5 mm, and the size of the apertures 4 was 4.7 mm$^2$ Furthermore, regarding the diamond-shaped aperture region 30*a* forming the first aperture region 11*a*, the length L3 in the Y direction was 28 mm, and the length L4 in the X direction was 53 mm. The V-shaped aperture region 30*b* forming the second aperture region 11*b* was formed such that the width W3 was 9 mm, and the angle β formed between one side and the straight line extending in the X direction was 30°. One side of the V-shaped non-aperture region 31*a* forming the first non-aperture region 12*a* was also formed to have the angle of 30°. The width W4 of the first non-aperture region 12*a* and the second non-aperture region 12*b* was 8 mm. In addition, the thickness of the nonwoven fabric substrate was measured under a presser foot having the diameter of 50.5 mm under the load of 0.3 kPa, by using a thickness measurer (model type FS-60DS) manufactured by DAIEI KAGAKU SEIKI MFG CO., LTD.

The whole basis weight of the nonwoven fabric substrate was 60 g/m$^2$, the basis weight of the ridges was 84 g/m$^2$, and the basis weight of the grooves was 59 g/m$^2$.

The wiping sheet of the first example was produced by impregnating the chemical solution into the manufactured nonwoven fabric substrate. The chemical solution to be impregnated was water/dodecyl glucoside (degree of condensation of 1.4, surfactant)/alkyl benzyl ammonium chloride (disinfectant)/ethanol=97.85/0.05/0.1/2, and impregnation amount of the chemical solution was 210% per unit weight of the nonwoven fabric substrate.

Example 2

The nonwoven fabric substrate for wiping sheet illustrated in FIG. 1 was manufactured by the method illustrated in FIG. 4. The nonwoven fabric substrate was manufactured using rayon (2.2 dtex and fiber length 38 mm; 60 wt %) and polyester fiber (2.2 dtex and fiber length 38 mm; 40 wt %) as a raw material, and the basis weight thereof was 60 g/m$^2$. Otherwise, the nonwoven fabric substrate similar to example 1 was manufactured.

Example 3

The nonwoven fabric substrate for wiping sheet illustrated in FIG. 1 was manufactured by the method illustrated in FIG. 4. The nonwoven fabric substrate was manufactured rayon (2.2 dtex and fiber length 38 mm; 70 wt %) and polyester fiber (2.2 dtex and fiber length 38 mm; 30 wt %) as a raw material, and the basis weight thereof was 54 g/m$^2$. Otherwise, the nonwoven fabric substrate similar to example 1 was manufactured.

Comparative Example 1

Except that the ridges and the grooves are formed such that the extending directions of the ridges and the grooves of the nonwoven fabric substrate do not intersect with but are parallel to the extending directions of both sides of the nonwoven fabric substrate, the wiping sheet of comparative example 1 was manufactured in the same manner as in example 1.

Comparative Example 2

Except that the nonwoven fabric substrate does not have the ridge and the groove, the wiping sheet of the second comparative example was manufactured in the same manner as in example 1.

[Performance Evaluation]

Regarding the wiping sheets of examples 1 to 3, and comparative examples 1 and 2, the wiping characteristics, and a sense of thickness were evaluated in accordance with the following method. The evaluation environment was a room temperature of 20° C. and humidity of 60% RH. The results are illustrated in Table 1 below.

[Collecting Characteristics of Solid Waste]

Ten pieces of crackers crushed to a square of 2 to 5 mm were spread on a wooden table of square of 30 cm, and the top thereof was measured by wiping by hand using the wiping sheet. The operation was conducted three times by preparing three per sample, and an average value thereof was obtained to be set as a wiping rate (%).

The wiping characteristics were evaluated based on the following criteria:

A: the collecting rate is 80% or more, and the collecting characteristics of the solid waste are satisfactory.

B: the wiping rate is 60% or more and less than 80%, and the collecting characteristics of the solid waste are practically sufficient level.

C: the wiping rate is 40% or more and less than 60%, and the collecting characteristics of the solid waste are inferior.

D: the wiping rate is less than 40%, the collecting characteristics of the solid waste are impracticable level.

[Absorbency of Liquid Dirt]

A meat sauce 2 g was applied on a wooden table of a square of 30 cm, and the top thereof was measured by wiping by hand using the wiping sheet. The operation was conducted three times by preparing three per sample, and an average value there was obtained to be set to absorbency (times) of the liquid dirt.

The absorbency of the liquid dirt was evaluated based on the following criteria:

A: Dirt could be completely removed by cleaning of three reciprocations or less.

B: Dirt could be completely removed by cleaning of five reciprocations or less.

C: Dirt could be completely removed by cleaning of ten reciprocations or less.

D: Dirt could not be completely removed for ten reciprocations or more.

[Sense of Thickness]

The wiping sheet was folded in four in a rectangular shape, and the sense of thickness of the folded wiping sheet was subjected to the sensory evaluation by 10 expert panelists, and the sense of thickness was measured according to the following criteria:

The sense of thickness was evaluated based on the following criteria:

A: Seven people or more evaluated satisfactorily.

B: Four to six people evaluated satisfactorily.

C: Two to three people evaluated satisfactorily.

D: One person or less evaluated satisfactorily.

TABLE 1

| | | Unit | First Example | Second Example | Third Example | First Comparative Example | Second Comparative Example |
|---|---|---|---|---|---|---|---|
| Collecting characteristics of solid waste | Wiping rate | % | 90 | 90 | 90 | 90 | 30 |
| | Evaluation | — | A | A | A | A | D |
| Absorbency of liquid dirt | Number of wiping | Times | 2 | 4 | 3 | 2 | 5 |
| | Evaluation | — | A | B | A | A | B |
| Sense of thickness | Evaluation | — | A | A | A | C | D |

As is apparent from the results illustrated in Table 1, the wiping sheets of examples 1 to 3 had high wiping characteristics and satisfactory sense of thickness compared to the wiping sheets of comparative examples 1 and 2.

INDUSTRIAL APPLICABILITY

The nonwoven fabric substrate for wiping sheet of the invention is able to efficiently wipe off granular solid waste or peeled dirt, and when the waste or the dirt is cleaned in a state of folded in a rectangular shape, the sense of thickness is improved.

In particular, when the sheet is used as a wet type wiping sheet by impregnating a chemical solution, more excellent effect is obtained.

The invention claimed is:

1. A nonwoven fabric substrate for wiping sheet in which ridges and grooves are alternately formed at positions corresponding to each other on each of both surfaces, and apertures penetrating the grooves of both surfaces are formed, wherein the ridges and the grooves extend parallel to each other, and extend in a direction intersecting with each pair of sides extending in parallel of the nonwoven fabric substrate for wiping sheet, in planar view, each of the grooves alternately includes an aperture portion which has a plurality of the apertures, and a non-aperture portion which has no aperture and is longer than a distance between the nearest end portions of the adjacent apertures in the aperture portion, and an arrangement pattern of the aperture portions and the non-aperture portions provided in the grooves is different from an arrangement pattern of the aperture portions and the non-aperture portions provided in adjacent grooves, when a whole of the nonwoven fabric substrate for wiping sheet is seen in planar view, the nonwoven fabric substrate for wiping sheet includes aperture regions formed by the aperture portions of the plurality of grooves, and non-aperture regions formed by the non-aperture portions of the plurality of grooves, each of the aperture regions and the non-aperture regions is arranged in a predetermined pattern, wherein the aperture regions include a first aperture region arranged in a pattern in which a diamond shape is periodically repeated and spaced/discrete, and a second aperture region arranged in a pattern in which a V shape is periodically repeated and connected/continuous, in the extending direction of the aperture regions, and the first aperture region and the second aperture region have a pattern arranged alternately with the non-aperture regions interposed therebetween in a direction orthogonal to the extending direction of the aperture regions, and wherein the non-aperture regions include a first non-aperture region in which the V shape is repeatedly arranged in the extending direction of the non-aperture regions, and a second non-aperture region in which an inverted V shape is repeatedly arranged in the extending direction of the non-aperture regions, so as to surround the diamond shapes of the first aperture region.

2. The nonwoven fabric substrate for wiping sheet according to claim 1, wherein each of the aperture regions and the non-aperture regions is arranged in a pattern in which each of the extending direction of the aperture regions and the extending direction of the non-aperture regions intersects with the extending direction of each of the ridges and grooves.

3. The nonwoven fabric substrate for wiping sheet according to claim 1, wherein the apertures are formed by dividing and rearranging constituent fibers of the nonwoven fabric substrate.

4. The nonwoven fabric substrate for wiping sheet according to claim 1, wherein the aperture regions include additional first aperture regions, wherein adjacent first aperture regions have the periodically repeated and spaced/discrete diamond shapes shifted by a half pitch.

5. The nonwoven fabric substrate for wiping sheet according to claim 1, wherein the non-aperture regions include additional first non-aperture regions, wherein adjacent first non-aperture regions have the repeatedly arranged V shapes periodically shifted by a half pitch.

6. The nonwoven fabric substrate for wiping sheet according to claim 1, wherein the non-aperture regions have a constant width in the extending direction of the non-aperture regions, and the width is wider than an interval between the apertures adjacent to each other in the direction of the grooves in the aperture portions.

7. The nonwoven fabric substrate for wiping sheet according claim 1, wherein the width of the first non-aperture region and the width of the second non-aperture region are formed in the same width.

8. The nonwoven fabric substrate for wiping sheet according to claim 1, wherein the nonwoven fabric substrate for wiping sheet is impregnated with a chemical solution.

* * * * *